US011084078B2

(12) United States Patent
Jeon et al.

(10) Patent No.: US 11,084,078 B2
(45) Date of Patent: Aug. 10, 2021

(54) ELECTRICAL DUST FILTER MANUFACTURING METHOD AND ELECTRICAL DUST FILTER MANUFACTURED THEREBY

(71) Applicant: NIT KOREA CO., LTD, Seongnam-si (KR)

(72) Inventors: Dong Hyun Jeon, Anyang-si (KR); So Young Jeon, Seongnam-si (KR)

(73) Assignee: NIT KOREA CO., LTD, Seongnam-si (KR)

( * ) Notice: Subject to any disclaimer, the term of this patent is extended or adjusted under 35 U.S.C. 154(b) by 419 days.

(21) Appl. No.: 16/074,526

(22) PCT Filed: Aug. 29, 2016

(86) PCT No.: PCT/KR2016/009563
§ 371 (c)(1),
(2) Date: Aug. 1, 2018

(87) PCT Pub. No.: WO2017/135539
PCT Pub. Date: Aug. 10, 2017

(65) Prior Publication Data

US 2019/0039077 A1 Feb. 7, 2019

(30) Foreign Application Priority Data

Feb. 4, 2016 (KR) ..... 10-2016-0014445

(51) Int. Cl.
*B21F 35/00* (2006.01)
*B21C 37/15* (2006.01)
(Continued)

(52) U.S. Cl.
CPC ..... *B21C 37/158* (2013.01); *B21C 37/08* (2013.01); *B21C 37/0803* (2013.01);
(Continued)

(58) Field of Classification Search
CPC ..... B21F 15/00; B21F 15/10; B21F 35/00; B21F 35/003; B21F 35/006; B21F 35/02;
(Continued)

(56) References Cited

U.S. PATENT DOCUMENTS 2,372,082 A * 3/1945 Iden ..... H01K 3/04
140/71.5
2,696,849 A * 12/1954 Flaws, Jr. ..... H01K 3/10
140/71.5
(Continued)

FOREIGN PATENT DOCUMENTS

JP 07328476 12/1995
KR 20080098567 11/2008
(Continued)

OTHER PUBLICATIONS

International Search Report—PCT/KR2016/009563 dated Dec. 8, 2016.

*Primary Examiner* — Edward T Tolan
(74) *Attorney, Agent, or Firm* — Cantor Colburn LLP

(57) ABSTRACT

Provided is an electrical dust-collecting filter manufacturing method and an electrical dust-collecting filter. The method includes the steps of: preparing a frame body, a dust-collecting electrode, a discharge electrode, and a discharge frame; assembling the dust-collecting electrode into an assembly hole of the frame body; connecting the discharge frame to the frame body via an insulating member; and arranging the discharge electrode in an axial direction inside the dust-collecting electrode via the discharge frame and fixing the same. The dust-collecting electrode assembling step includes: temporarily elastically deforming the dust-collecting electrode in the radial direction and inserting the same into the assembly hole of the frame body; and pressurizing end parts of both ends of the dust collecting electrode, which protrude out of a plate member when fitted
(Continued)

into the assembly hole, in the axial direction such that the end parts are compressed against the surface of the plate member.

6 Claims, 14 Drawing Sheets

(51) Int. Cl.

| | |
|---|---|
| ***B21F 45/16*** | (2006.01) |
| ***B21C 37/08*** | (2006.01) |
| ***B21F 45/20*** | (2006.01) |
| *B03C 3/41* | (2006.01) |
| *B03C 3/49* | (2006.01) |
| *B03C 3/06* | (2006.01) |
| *B03C 3/86* | (2006.01) |
| *B03C 3/08* | (2006.01) |
| *B03C 3/47* | (2006.01) |

(52) U.S. Cl.
CPC ..... *B21C 37/0815* (2013.01); *B21F 35/00* (2013.01); *B21F 35/003* (2013.01); *B21F 45/16* (2013.01); *B21F 45/20* (2013.01); *B03C 3/06* (2013.01); *B03C 3/08* (2013.01); *B03C 3/41* (2013.01); *B03C 3/47* (2013.01); *B03C 3/49* (2013.01); *B03C 3/86* (2013.01); *B03C 2201/04* (2013.01); *B03C 2201/10* (2013.01); *B03C 2201/20* (2013.01)

(58) Field of Classification Search
CPC ..... B21F 45/00; B21F 45/20; B23P 19/048; B03C 3/06; B03C 3/10; B03C 3/40; B03C 3/45; B03C 3/49; B21C 37/0803; B21C 37/15; B21C 37/158; Y10T 29/49826; Y10T 29/49872
USPC ..... 140/71.5, 71.6
See application file for complete search history.

(56) References Cited

U.S. PATENT DOCUMENTS

| | | | | | |
|---|---|---|---|---|---|
| 4,247,307 | A * | 1/1981 | Chang | B03C 3/40 | 95/79 |
| 4,296,621 | A * | 10/1981 | Ohdai | B21F 35/02 | 140/103 |
| 4,360,367 | A * | 11/1982 | Prior | B03C 3/41 | 96/87 |
| 4,895,540 | A * | 1/1990 | Siaens | H01K 1/18 | 140/71.5 |
| 6,544,317 | B2 * | 4/2003 | Miller | B03C 3/47 | 95/63 |
| 7,357,381 | B2 * | 4/2008 | Wakamori | F16D 25/12 | 267/179 |
| 2004/0090103 | A1 * | 5/2004 | Yamada | B21C 37/108 | 297/391 |
| 2017/0203304 | A1 * | 7/2017 | Roux | B03C 3/86 | |

FOREIGN PATENT DOCUMENTS

| | | |
|---|---|---|
| KR | 20110045015 | 5/2011 |
| KR | 20130029221 | 3/2013 |
| KR | 20140110513 | 9/2014 |
| KR | 101506324 | 3/2015 |

* cited by examiner

ELECTRICAL DUST FILTER MANUFACTURING METHOD AND ELECTRICAL DUST FILTER MANUFACTURED THEREBY

BACKGROUND OF THE INVENTION

1. Field of the Invention

The present invention relates to a method for manufacturing an electrical dust filter and the electrical dust filter manufactured by the same, in particular the method for manufacturing the electrical dust filter removing various micro particles in a contaminated stream by making the particles be charged in the stream in the course of passing a collecting electrode in a manner of discharging by means of a discharging electrode displaced within a cylindrical shape of the collecting electrode.

2. Description of the Related Art

The electrical filter is an apparatus for collecting a dust charged as positive or negative by making a collecting electrode as positive and a discharging electrode as a negative. The filter can apply a high voltage between the collecting electrode and the discharging electrode for collecting dust to generate a corona discharge, and can collect various particles such as dust, gas or foul smell by an electrical force generated from an non-uniform electrical field.

Therefore, the electrical filter may be used in a large industrial facility generating a large of dust, gas or bad smell. And also it may be utilized for removing a large amount of oil mist generated in the course of recovering a polluted soil by thermal desorption in an industrial facility to store or handle oil products, or in the course of producing a fiber or polymer product in the related manufactory. And also the electrical filter may be used for clearing dust or bad smell generated from a cleaner, an air conditioner or a hood in a home or eatery.

There is Korean Patent No. 10-1506324 'A range hood type of a plasma electrical dust collecting filter apparatus' that is invented by the inventor of this application and registered in KIPO as a known electrical dust collecting filter apparatus. Referring to FIG. 1, The above-mentioned apparatus 201 comprises a dust collecting electrode module 203 with a plurality of cylindrical dust collecting electrodes 213; an electrical discharging electrode module 205 secured within each dust collecting electrode 213 and having a plurality of an electrical discharging electrodes 215 connected by an electrical discharging frame 207; and a plurality of insulators 209 displaced between the dust collecting electrode module 203 and the electrical discharging electrode module 205 for insulating both of the module 203, 205. Therefore, the filter apparatus 201 can purify the object stream by making various particles introduced into each dust collecting electrodes 213 from outside have electrical charge for collecting within the dust collecting electrodes 213. For the above-mentioned function, as shown in FIG. 1, a plurality of dust collecting electrodes 213 are arranged in parallel between an upper plate 217 and a lower plate 217, and each electrical discharging electrode 215 is arranged within each corresponding dust collecting electrode 213 in the axial direction. In such structure, as shown in FIG. 1 as a large view, each dust collecting electrode 213 is inserted into a plurality of assembling holes 218 penetrated into the upper plate and lower plate 217, and some boundary part to the assembling holes 218 is welded at three, four or more than parts of welding part 219. But as shown in FIG. 1, the thickness of the dust collecting electrode 213 should become certain value for welding the dust collecting electrodes 213. Hence the total weight of the filter apparatus 201 increases to make disadvantage in movement, transfer or handling of the filter apparatus 201, resulting in decreasing the manufacturing efficiency. And also, the known filter apparatus has a disadvantage that the manufacturing cost increases high depending on the manufacturing time and workmanship because many welding work has to be repeated, resulting in decreasing productivity. And also, the welding work performed to the vertical direction may make the upper and lower plates 217 or the dust collecting electrode 213 be penetrated or be damaged resulting in decreasing the durability or the stream leakage because of the little thickness of the upper and lower plate 217. Hence the known filter apparatus 201 have disadvantage of some lower capability in the whole. And also, it is difficult for the dust collecting electrode 213 to be replaced due to damage and the like because the dust collecting electrode 213 is welded to the upper and lower plate 217 at the welding part 219.

SUMMARY OF THE INVENTION

The purpose of the present invention is provided with a method for producing an electrical filter in which a plastic process is substituted for assembling a frame with a fixing hole for assembling a collecting electrode, and hence the total weight of the filter can be reduced by preventing the collecting electrode from being thick to improve the process efficiency and the handling easiness as well as simplify the assembling process.

An another purpose of the present invention is to provide a method for manufacturing an electrical dust filter to reduce the possibility of a damage or a defect on assembling to improve a quality of the dust filter.

An another purpose of the present invention is to provide an electrical dust filter in which a damaged or aged collecting electrode can be exchanged easily, in particular on operating, to result in reducing a maintaining or repairing cost.

In an embodiment of the present invention, method for producing an electrical dust filter comprises: preparing a board type of a frame to have a plurality of assembling holes, a collecting electrode to have a plurality of hooking protrusions protruded on a circumference adjacent to an end part 25 and arranged along a periphery, a discharging electrode to generate an electrical discharge and be arranged along an axle line direction, and a discharging frame to couple the discharging electrode to the frame in an insulating state; assembling the collecting electrode to the assembling holes of the frame; coupling the discharging electrode to the frame with an insulating member after the collecting electrode is inserted into the assembling hole; and arranging the discharging electrode on the frame in direction of the axle line within the collecting electrode wherein the discharging frame is insulated from the frame, wherein the step of assembling comprising, inserting the collecting electrode into the assembling holes of the frame by deforming the collecting electrode temporarily with elasticity in a radial direction; and forming a boundary part by pressing the end parts of both of the collecting electrode on a surface of a plate member protruded out of the plate member on being inserted into the assembling holes in the axil direction, wherein the step of the preparing comprising, cutting a wire W with a length corresponding to that of the discharging electrode; forming a connecting means at both ends of the wire; and forming a tensile spring at either end of the wire with the connecting means in an adjacent inner part of the connecting means in the axial direction.

In other embodiment of the present invention, the preparing step further comprises, protruding a plurality of hooking protrusions at the end part according to a pair of opposite sides among four sides of the rectangular metal board object; rolling the other opposite sides among four sides of the rectangular metal board object to protrude the hooking protrusions; and welding the other opposite sides of the metal board S to meet by rolling.

In another embodiment of the present invention, the connecting means comprises, a front angled part formed by bending the end part of the discharging electrode bordering a first bending part angled backwardly and eventually to a second bending part; and a rear angled part formed by bending the discharging electrode bordering the second bending part to contact the wire rear end of the discharging electrode with an inner wall of the discharging frame at the opposite part of the second bending part.

In still another embodiment of the present invention, the discharging frame is placed at one side of the board member 11, and the discharging electrode has a shape of a circular section rod supported by the discharging frame.

In still another embodiment of the present invention, the discharging electrode has a plurality of discharging cores protruded around the circular section rod in the radial direction.

In still another embodiment of the present invention, in the step of installing the insulating member, the insulating member is secured in removable structure within the frame to avoid a contact with a fluid.

In still another embodiment of the present invention, the electrical dust collecting filler manufactured by the above method comprises: a frame forming a shape; a plurality of dust collecting electrodes installed between a plurality of board members separated each other and penetrating the plurality of board members in order that a fluid to be collected can pass; and a plurality of discharging electrodes arranged within the dust collecting electrode in the axial direction using a plurality of discharging frames coupled to the frame in insulating structure respectively, wherein each dust collecting electrode has a boundary part to secure within a plurality of assembling holes, wherein the boundary part is formed by folding reversely to the surface of the board member when inserting into a plurality of assembling holes of the frame.

In still another embodiment of the present invention, the dust collecting electrode comprises a plurality of hooking protrusions placed at the distal part adjacent to the boundary part and protruded at an outer circumference to secure the board member 11 between boundary parts.

In still another embodiment of the present invention, the boundary part has a ring shape to have an arch shape longitudinal section.

In accordance to the method for manufacturing the electrical dust collecting filter and the electrical dust collecting filter thereby, the distal part of the dust collecting electrodes are protruded partly in the outside when the dust collecting discharging electrode is assembled to the frame. When the dust collecting electrode is placed at the predetermined location, the boundary part can be formed by contacting both of the end parts of the dust collecting electrode at the surface of the board member with a pressing tool thereby to finish the assembling process of the dust collecting electrode simply. Therefore, it is possible for the dust collecting electrode to be thin and light, because the dust collecting electrode is not welded to the board member. Hence the manufacturing efficiency can increase in spite of a large number of the dust collecting electrodes. And also, because the dust collecting electrode is coupled to the frame with a plastic process, any damage or defect may not be made on the dust collecting electrode or the frame in the course of assembling, resulting in the increased quality of the dust collecting filter. And also, the dust collecting electrode can be separated from the assembling holes by unfolding the boundary part folded reversely, therefore the dust collecting electrode can be exchanged easily, resulting in an increased maintenance.

BRIEF DESCRIPTION OF THE DRAWINGS

The above and other aspects, features and advantages of certain exemplary embodiments of the present invention will be more apparent from the following detailed description taken in conjunction with the accompanying drawings, in which.

DETAILED DESCRIPTION OF EXEMPLARY EMBODIMENTS

Exemplary embodiments of the present invention will be described herein below with reference to the accompanying drawings. In the following description, well-known functions or constructions are not described in detail since they would obscure the invention in unnecessary detail. Also, the terms used herein are defined according to the functions of the present invention. Thus, the terms may vary depending on intension and usage. That is, the terms used herein must be understood based on the descriptions made herein.

Figure 1:
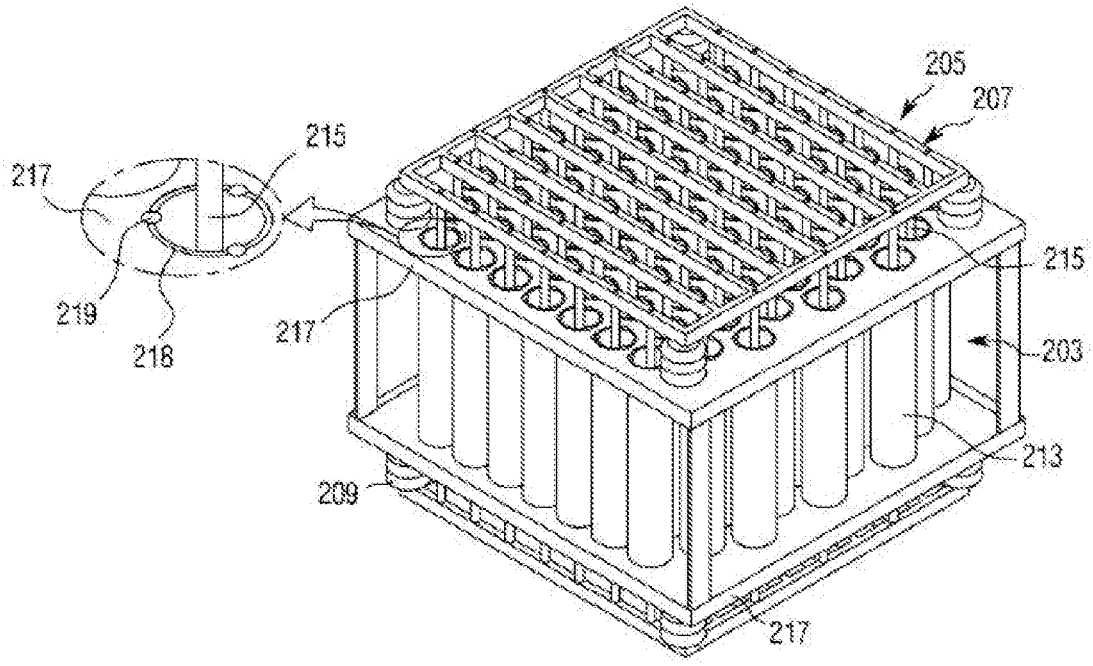
Prior Art FIG. 1
FIG. 1 shows a perspective view of a known electrical dust collecting filter.
Figure 2:
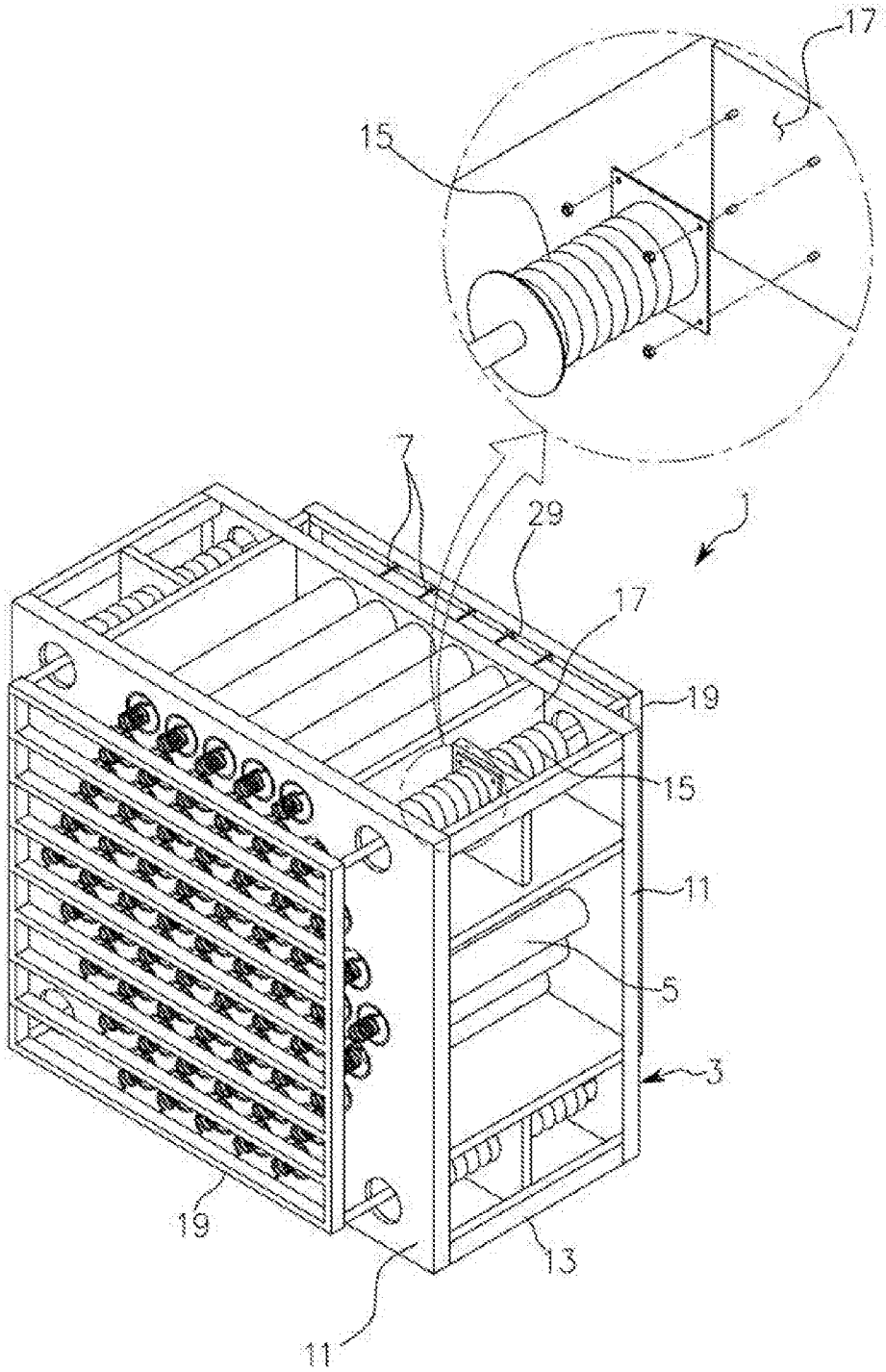
FIG. 2 shows an electrical dust filter according to an embodiment of the present invention.
Figure 3:
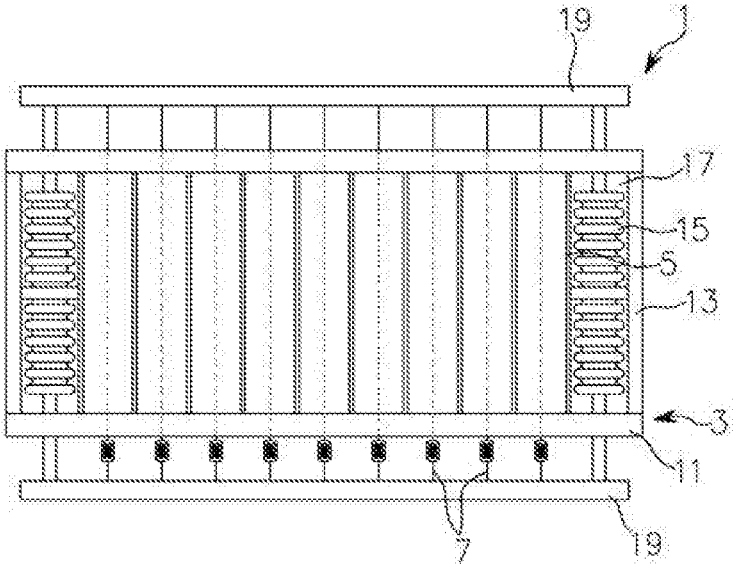
FIG. 3 shows a top view of the electrical dust filter of FIG. 2.

As shown FIGS. 2 and 3, the electrical dust collecting filter 1 comprises a frame 3, a plurality of dust collecting electrodes 5 and a plurality of discharging electrodes 7.

The frame 3 may make a whole shape of the dust collecting filter 1, and may have, not limited to, a shape of a rectangle parallelepiped in order that the plurality of dust collecting electrodes 5 and the discharging electrodes 7 can be arranged side by side in a path of a fluid to be collected. The frame 3 may comprise a pair of board members 11 to be placed at the entering part and exiting part of the fluid to pass the dust collecting electrodes 5, respectively, and a plurality of connecting members 13 placed at corner parts of the board members 11 for connecting the board members 11.

And also, an insulating member 15 such as an insulator or the like may be installed within the frame in order that to connect a discharging frame 19 to the frame in an insulating state, wherein the insulating member 15 may be fixed in an insulting room 17 in order to insulate to the discharging frame 19 and to decrease the contacting amount of the fluid for avoiding some contamination. At the same time, the discharging frame 19 may be separated from the frame 3 by being secured within the insulating room 17 in removable fashion.

Figure 10:
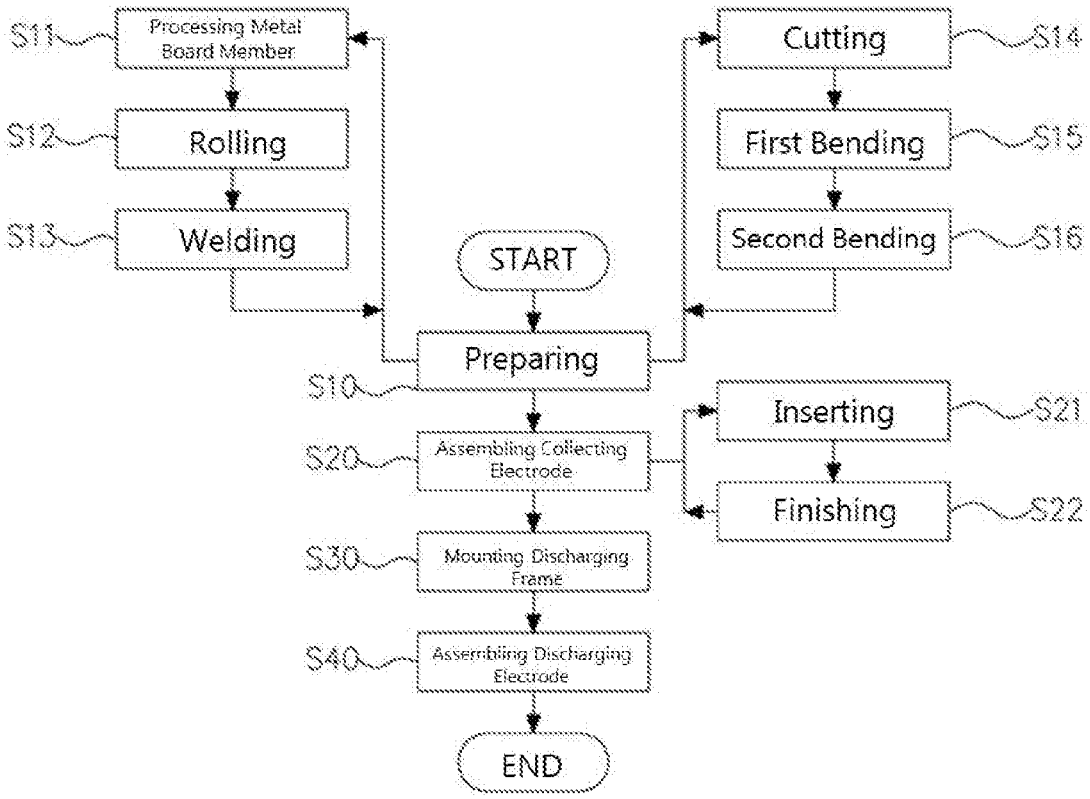
FIG. 10 shows a method for manufacturing an electrical dust filter according to an embodiment of the present invention.
Figure 11:
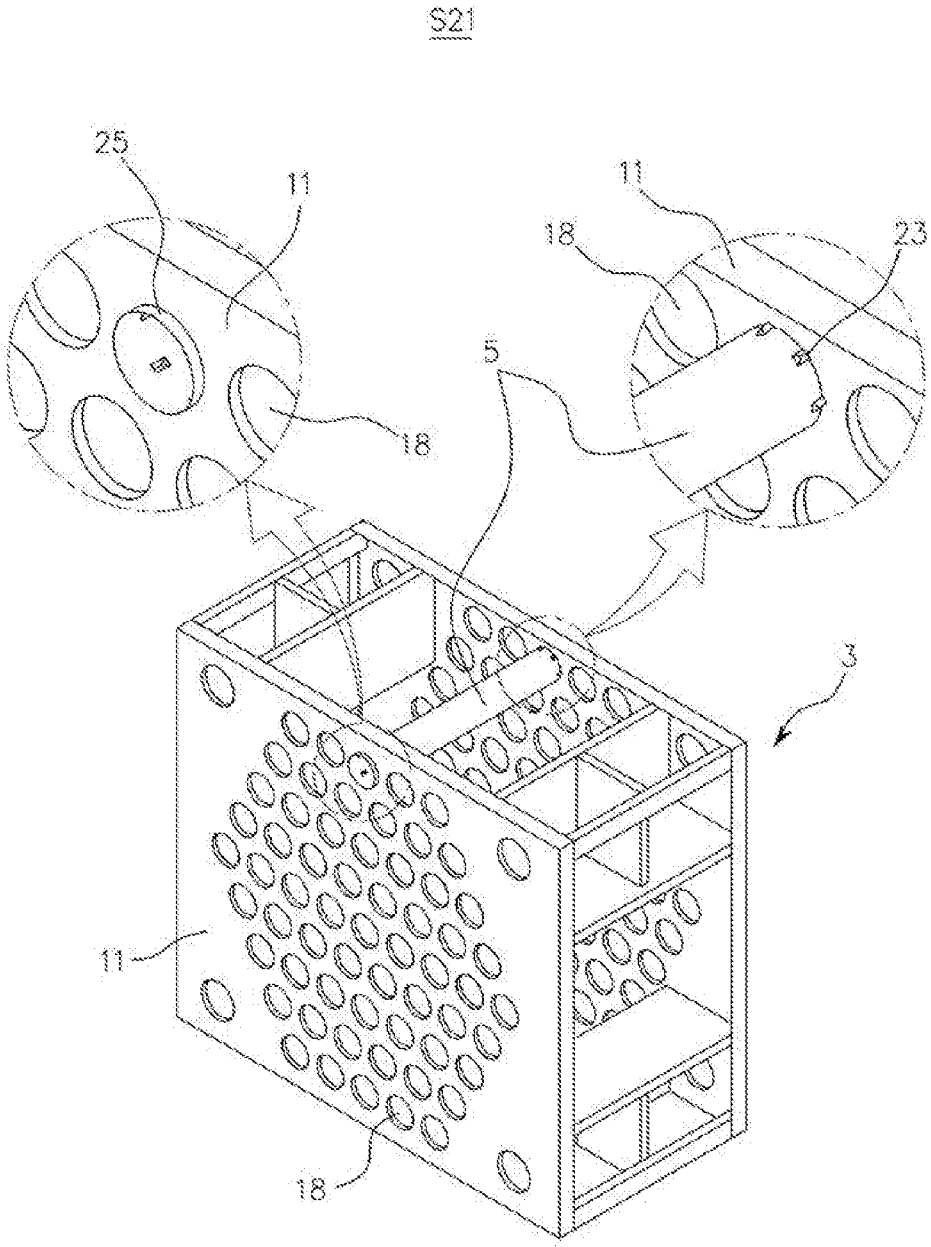
FIG. 11 shows a process for inserting according to an embodiment of the present invention.
Figure 12:
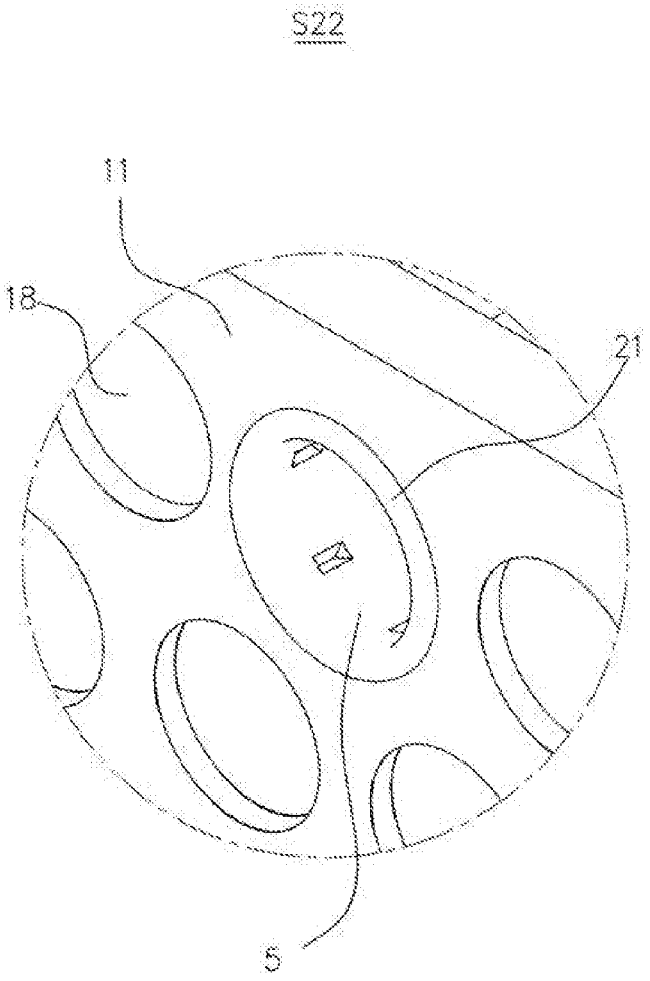
FIG. 12 shows a process for finishing according to an embodiment of the present invention.
Figure 13:
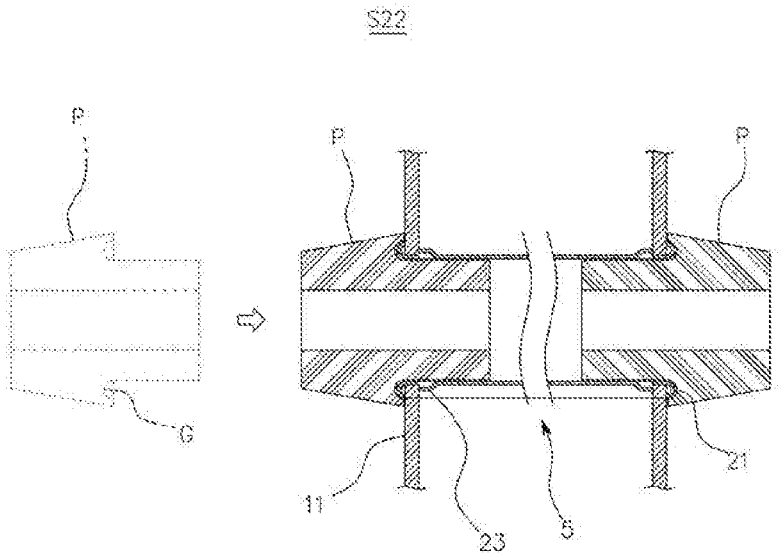
FIG. 13 shows a sectional view of the collecting electrode pressed by a pressing tool according to an embodiment of the present invention.
Figure 14:
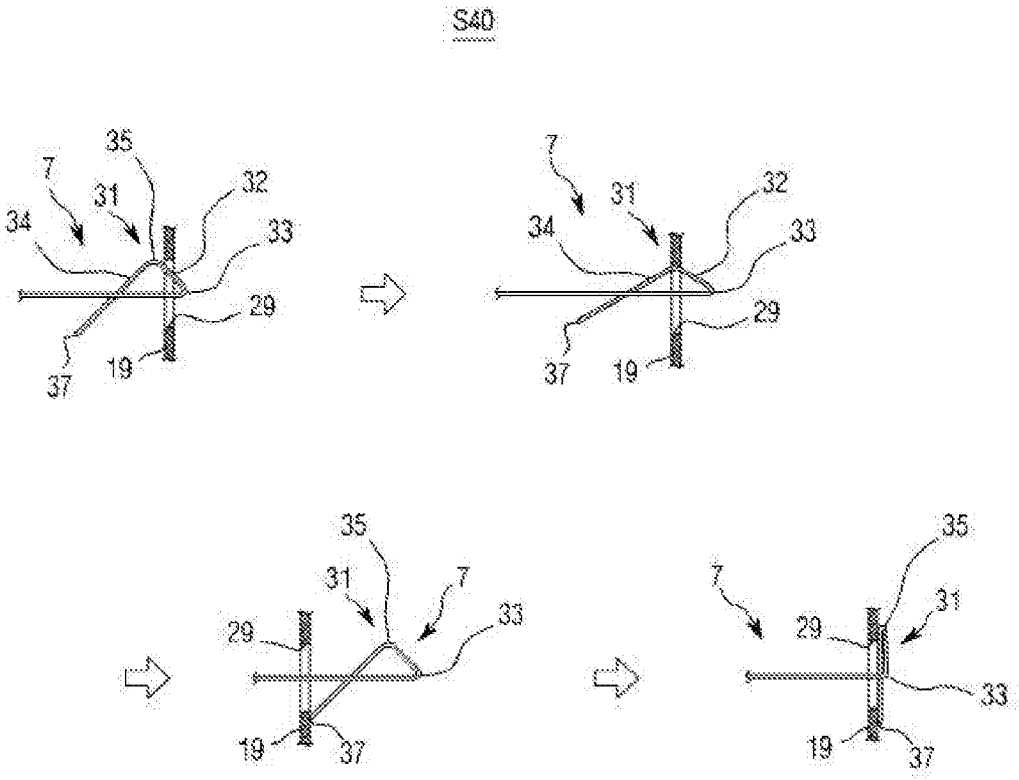
FIG. 14 shows a process for assembling the discharging electrode according to an embodiment of the present invention.

The plurality of dust collecting electrodes 5 and discharging electrodes are installed at the frame 3, and a plurality of assembling holes 18 may be formed to penetrate the board member 11 for installing the dust collecting electrode 5, as shown in FIG. 10 and the like. And also, the pair of discharging frame 19 for installing the discharging electrode 7 may arrange side by side at an outer part of the board member 11.

The dust collecting electrode 5 is a board shape of material, and the fluid passes through the dust collecting electrode 5 and some particles such as dust, gas or bad smell components may be captured by the dust collecting electrode 5. As shown in FIGS. 2 and 3, the plurality of dust collecting electrodes 5 are arranged between the board members 11. The dust collecting electrodes 5 may penetrate the board members 11 for capturing dust, and the plurality of dust collecting electrodes 5 may capture dust and the like from the fluid to pass all together.

Figure 4:
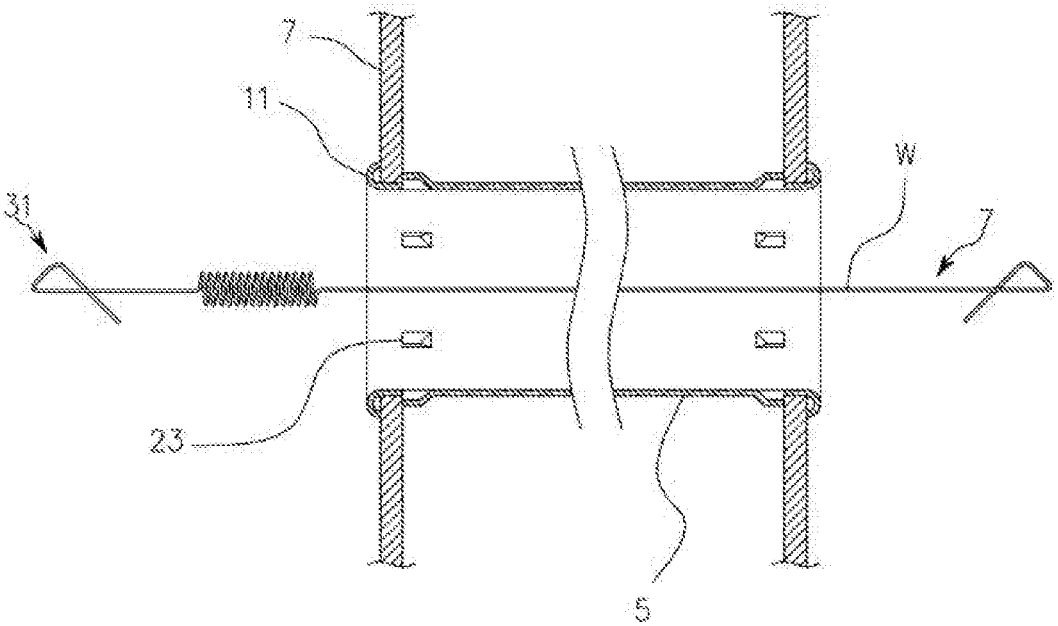
FIG. 4 shows a sectional view of the electrical dust filter depicting a collecting electrode and a discharging electrode together in FIG. 3.
Figure 5:
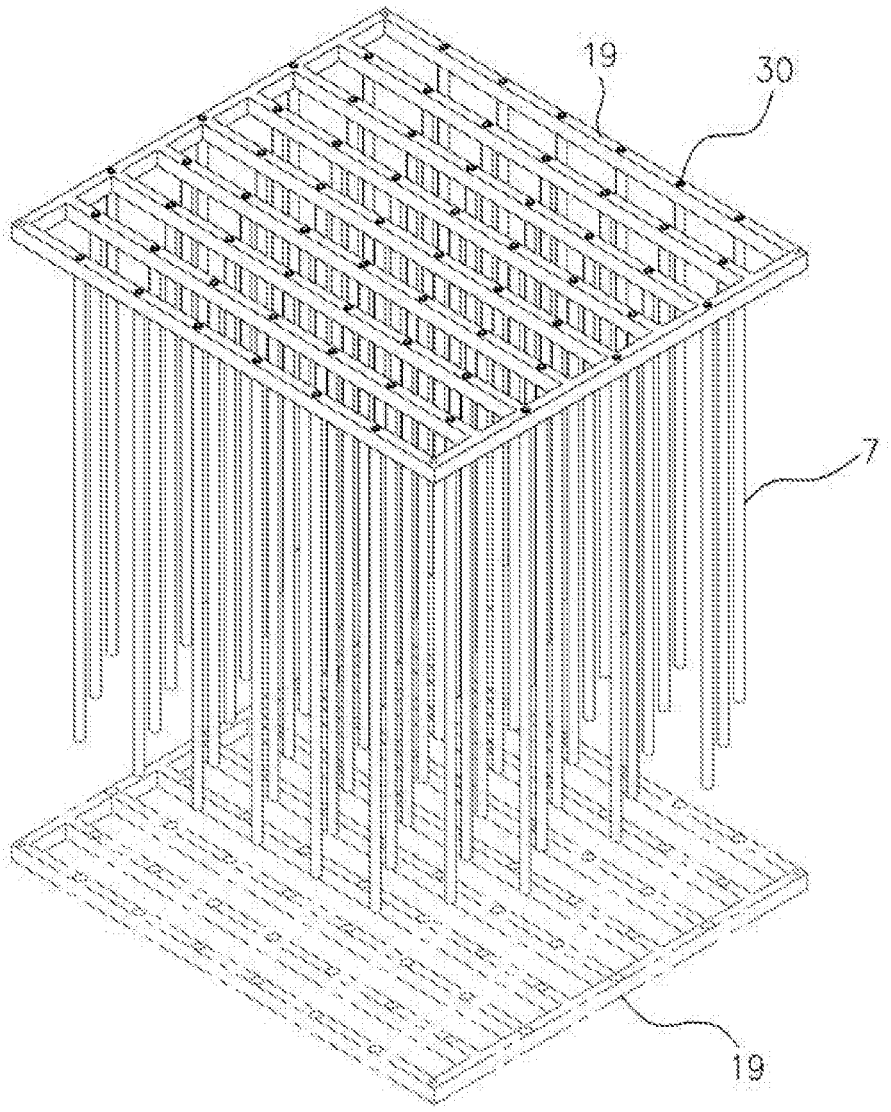
FIG. 5 shows another discharging electrode according to an embodiment of the present invention.
Figure 6:
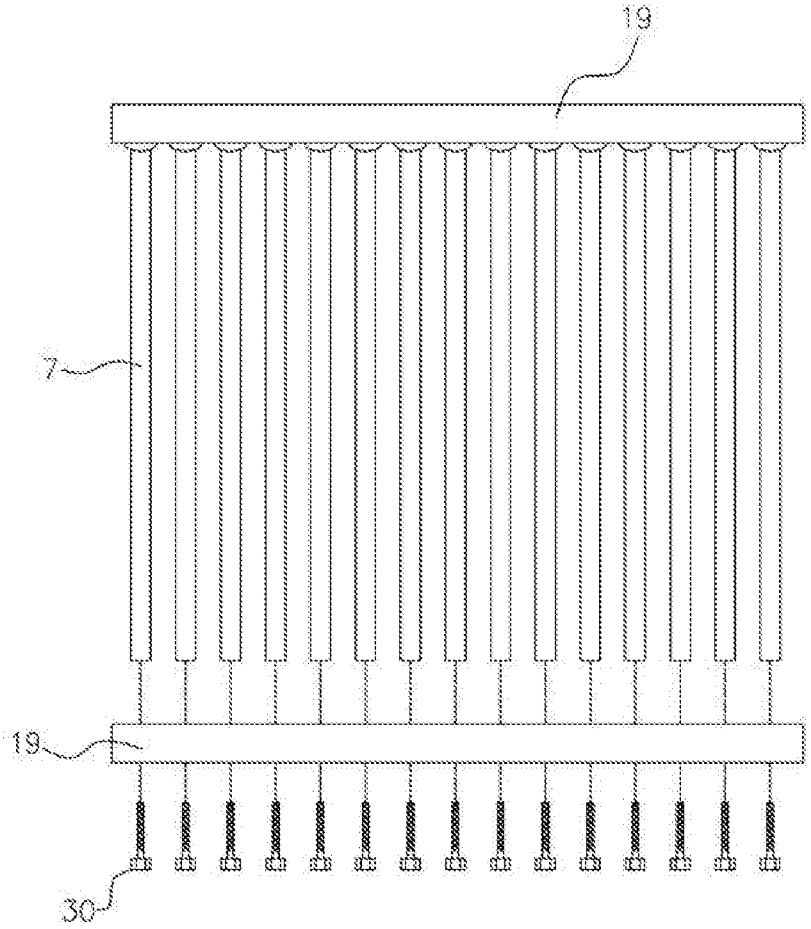
FIG. 6 shows a method for fixing the discharging electrode according to an embodiment of the present invention.
Figure 9:
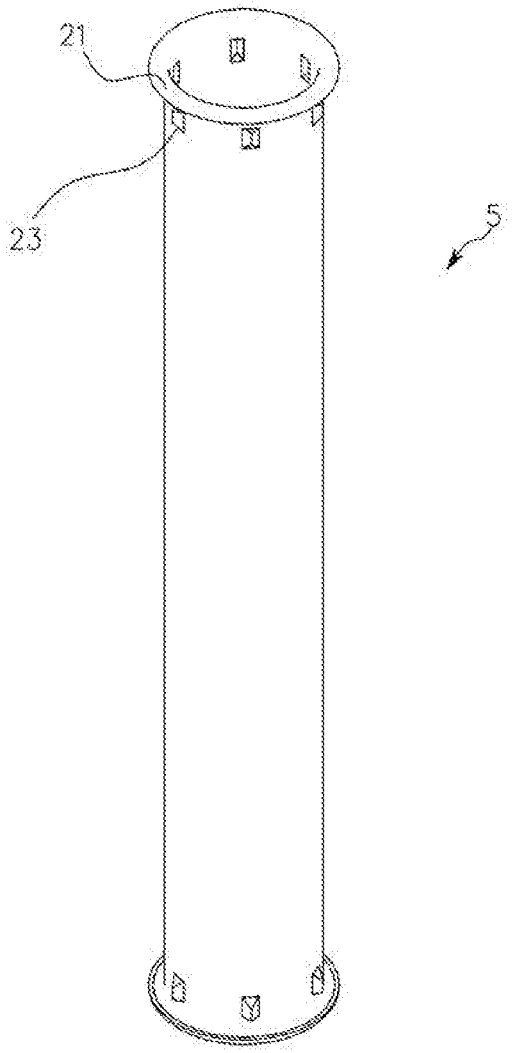
FIG. 9 shows a collecting electrode with discharging cores according to an embodiment of the present invention.
Figure 15:
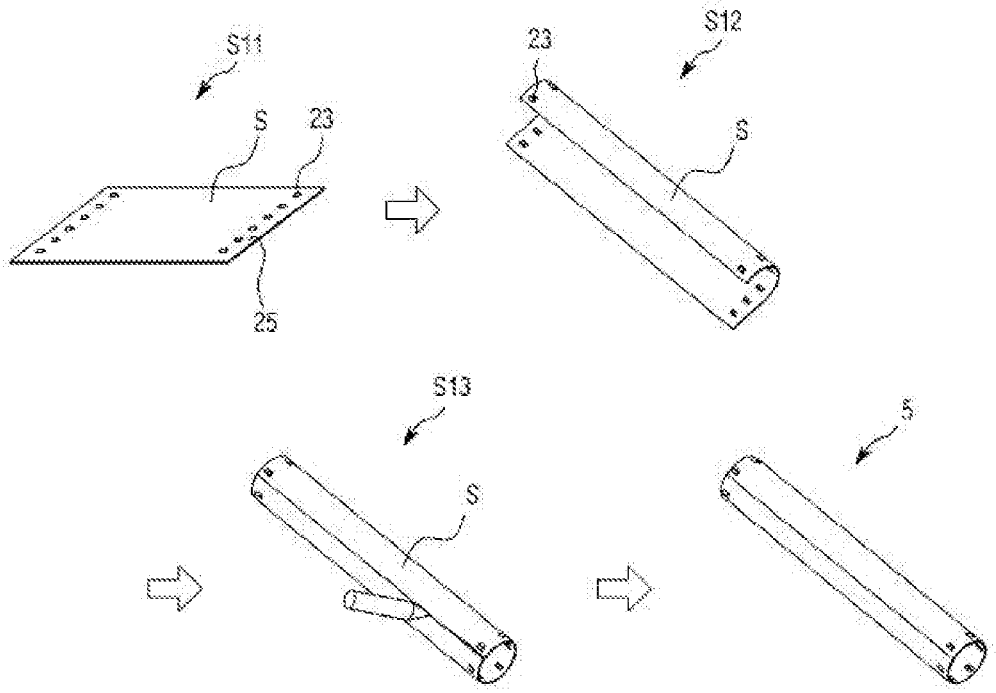
FIG. 15 shows a process for making the collecting electrode according to an embodiment of the present invention.

In particular, as shown FIG. 15, the dust collecting electrode 5 is made from a thin metal board material to become a light structure. And as shown FIG. 10, both of the distal parts of front and rear fold reversely in outside direction to form a boundary part 21, as shown in FIG. 4 and FIG. 9. As shown in FIG. 4, the boundary part 21 has an arch shape in longitudinal view to become a ring structure, but the boundary 21 may have various shapes depending on a longitudinal pressing shape of a pressing tool P. The boundary part 21 contacts closely on a surface of the board member 11 on being inserted into the assembling holes 18 of the frame 3, thereby the dust collecting electrode 5 is fixed at the frame tightly with the assembling holes 18.

And also, as shown in FIG. 4 to FIG. 10, a plurality of hooking protrusions 23 may protrude at an inner part of an outer circumference of the distal parts 25, and the hooking protrusions 23 may be arranged along the circumference corresponding to the boundary part 21 to be placed between the board member 11, thereby the contacting force of the boundary part 21 to the board member 11 or the frame 3 may be increased.

The discharging electrode 7 may generate an electric field for electric discharging together with the dust collecting electrode 5, and, as shown in FIG. 2 to FIG. 4, the plurality of discharging electrodes 7 may be arranged within each corresponding dust collecting electrode 5 in the axial direction. One end of the discharging electrode 7 is fixed at one discharging frame 19 placed at the entering part of the fluid, while the other end of the discharging electrode 7 is fixed at the other discharging frame 19 placed at the exiting part of the fluid in removable fashion. In such structure, as mentioned above, each discharging frame 19 is arranged at the outer part of the board member 11 using the insulating member 15, hence each discharging electrode 7 may be fixed to the frame 3 with insulated to the dust collecting electrode 5.

Figure 16:
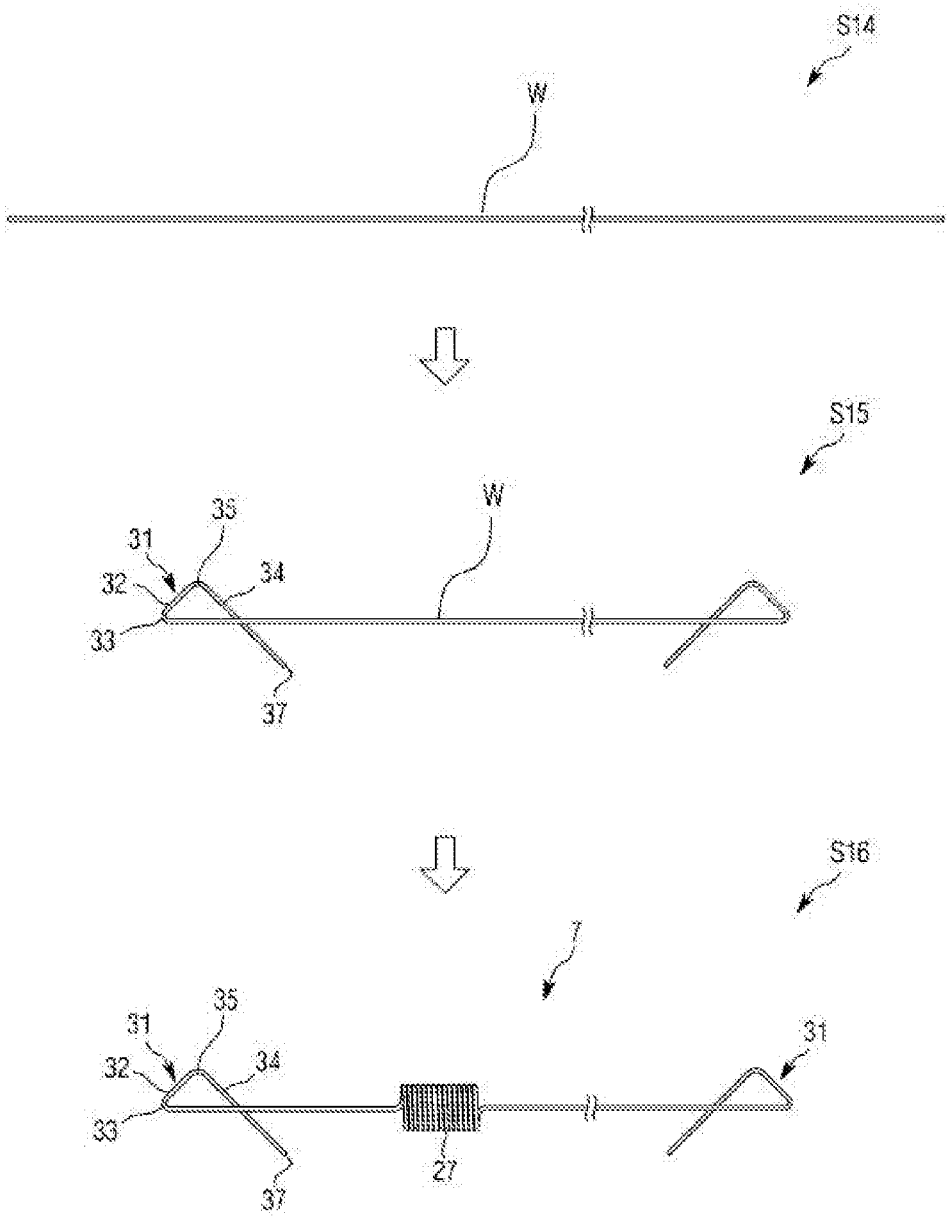
FIG. 16 shows a process for making the discharging electrode according to an embodiment of the present invention.

As shown in FIG. 4 and FIG. 16, each discharging electrode 7 is made as in a shape of a wire W to decrease the total weight of the filter 1. A connecting means 31 is used for fixing both ends of the discharging electrode 7 to substitute for welding, and the discharging electrode 7 can be coupled to the discharging frame 19 in removable fashion with the connecting means 31.

As shown in FIG. 4 and FIG. 16, the connecting means 31 may have, not limited to, a bent shape produced by bending the end part of the wire W used as the discharging electrode 7 to be assembled in one touch manner. The connecting means 31 may comprise a front angled part 32 and a rear angled part 34. As shown in FIG. 4, the front angled part 32 may be formed by bending the both ends of the wire at first bordering a first bending part 33, wherein the front angled part 32 may be angled eventually from the axial line in the backward direction to extend to a second bending part 35. And also, the rear bending part 35 is formed by bending the end part of the bent wire at second bordering a second bending part 35, wherein the rear bending part 35 extends downwardly from the second bending part 35 to contact the inner surface of the discharging frame 19 at the opposite when a rear part 37 of the wire is inserted into the assembling hole 29 at first. But, as shown in FIG. 9, the discharging frame 19 also comprise an assembling hole 29 for inserting the connecting means 31 with a little diameter in order to form the connecting means 31 at the end parts of the discharging electrode.

As shown in FIG. 4, an elastic spring 27 may be formed at either end of the discharging electrode 7. And the elastic spring 27 may be placed adjacent to the connecting means 31 along the axial line of the wire W. Hence, the discharging electrode 7 is not loosened owing to high heat in the course of discharging in spite of a little diameter, because the discharging electrode 7 is drawn previously when the discharging electrode 7 is inserted.

The frame 3 may have a structure capable of securing the plurality of collecting electrodes 5 and discharging electrode 7, hence a plurality of assembling holes 18 may be formed through the board 11 as described below. And also, the pair of discharging frames 19 may be displaced in an outer part of the board 11 in parallel.

The collecting electrode 5 may become a route, and a collecting space collecting particles such as dust, gas, bad smell and the like. The collecting electrode 5 may be a shape of a board made from a metal and may have a shape of a cylinder, a polyhedron or the like. Each collecting electrode 5 may be secured between the upper and lower board 11 of the frame 3 in parallel and each end part of the collecting electrodes 5 may penetrate the board 11 to form each passage respectively and to collect the particles together. In particular, the collecting electrodes 5 may be a shape of a thin metal board to make a light structure, and both end parts 25 of each collecting electrode 5 may be folded outward to form a boundary part 21. The boundary part 21 may become a ring structure having a shape of an arch in a longitudinal sectional view, but the shape of the boundary part 21 may be processed as various forms according to a pressing surface of a press tool P. When the boundary part 21 folded outward is inserted in the assembling hole 18 of the frame 3, the collecting electrode 5 can contact closely to the surface of the board 11 to be secured to the assembling hole 18 or the frame 3 tightly. And also, a plurality of hooking protrusions 23 may be protruded at an inner part of the outer circumferential surface adjacent to the boundary part 21 of the end part 25 arranged in the direction of the circumference as corresponding to the boundary part 21. And then board member 11 may be between the boundary part 21 and the hooking protrusion 23 to increase the contacting force to the frame 3.

The discharging electrode 7 made from a metal material in the form of a cylinder can generate an electrical field with the collecting electrode 5 to make a corona discharging, and the discharging electrode 7 may be arranged in the axial direction as one by one. One end of the discharging electrode 7 may be secured at one side of the discharging frame 19, while other end of the discharging electrode 7 may be secured at the other side of the discharging frame 19. The discharging frame 19 may be displaced at the outer side of the board member 11 using the insulating member 15. And hence, the discharging electrode 7 may be secured to the discharging frame 19 as insulated to the frame 3 and the collecting electrode 5. The discharging electrode 7 may be a form of a wire for reducing the total weight of the filter 1 by reducing the diameter of the discharging electrode 7. A connecting unit 31 may be utilized for fixing each end of the discharging electrode 7 instead of welding, and the connecting unit 31 can fix the discharging electrode 7 at the discharging frame in removable fashion.

The connecting unit 31 may have various structures, and preferably the connecting unit 31 may have a form in which the connecting unit 31 can be coupled as one touch by making a bending structure wherein the bending structure is made by bending the end part of the wire that is the discharging electrode 7. The connecting unit 31 comprises a front end angled part 32 and a rear end angled part 34. The front end angled part 32 may be formed by bending both ends of the wire as a first bending part 33 is a boundary, wherein the bent part may be angled as the wire is more apart from the axial line as proceeding backward, and then the wire extends to a second bending part 35. The rear end angled part 34 may be formed by bending the first bent ends of the wire as a second bending part 35 is a boundary, wherein the bent part extends downwardly in an angled direction to contact an inner surface of the discharging frame 19 at the opposite of the second bending part 35 when the rear part 37 of the wire is inserted into the connecting hole 29. Both ends of the discharging electrode 7 may have the connecting holes 29 having a smaller diameter than a gap between the second bending part 35 and the rear end part 37 of the wire to form the connecting unit 31 at the both ends of the discharging electrode 7. As an alternative example shown in FIG. 5, the discharging electrode 7 may be a shape of a rod with a circular section. In such case, the discharging electrode 7 can be secured at one side of the discharging frame 19 with the connecting member 30, or welded permanently. The other end of the discharging electrode 7 may be fixed or not fixed. Specifically, the other end of the discharging electrode 7 may be coupled with the connecting member 30 in removable fashion, while the other end of the discharging electrode 7 can be supported as a cantilever structure. Therefore, the discharging frame 19 may be installed only at one side of the board member 11.

Figure 7:
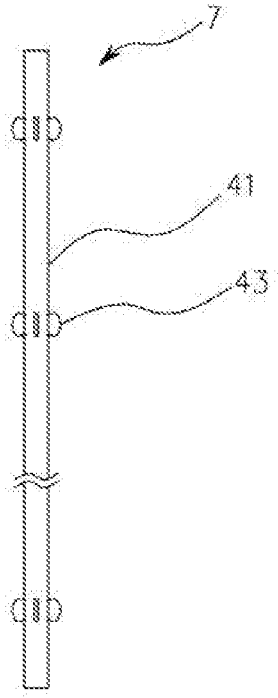
FIG. 7 shows another discharging electrode according to an embodiment of the present invention.
Figure 8:
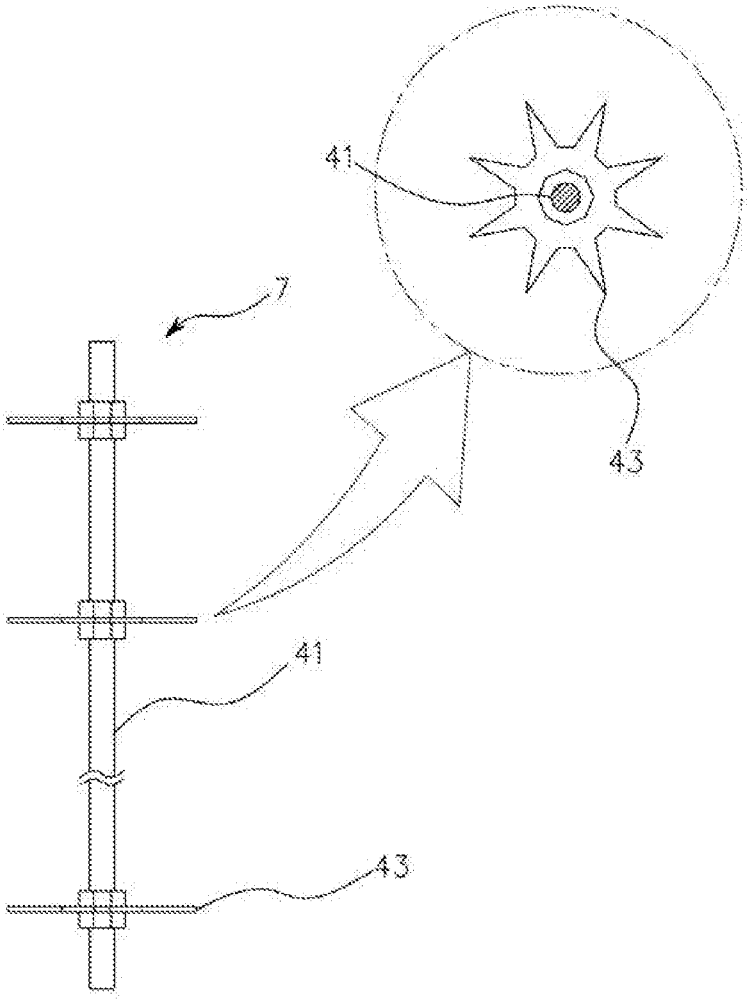
FIG. 8 shows another discharging electrode according to an embodiment of the present invention.

As shown in FIGS. 7 and 8, if the discharging electrode 7 has the shape of the rod, a plurality of discharging cores 43 may be protruded at an outer circumferential surface in a radial direction. The discharging cores 43 may have a sharp end parts to discharge electrons easily. The discharging cores 43 may be formed by pressing the outer circumferential surface of the discharging electrode 7 as a protrusion. The discharging cores 43 may be formed by securing an octagonal star shape of a plane member at the outer circumferential surface of the discharging electrode 7.

The electrical dust filter 1 may generate an electrical field by making the collecting electrode 5 and the discharging electrode 7 positive and negative, respectively. The particles to be collected and contained in the stream such as dust, gas, bad smell or the like may be discharged as negative ions by a corona discharge of the discharging electrode 7 to be collected at the collecting electrode. And the purified stream can be exhausted out of the filter 1.

The method for manufacturing the filter is described in detail below.

FIG. 10 shows a method for manufacturing an electrical dust filter according to an embodiment of the present invention.

Referring to FIG. 10, the method for manufacturing the electrical dust filter comprises a preparing step S10, an assembling step of the collecting electrode S20, a mounting step of the discharging frame S30 and an assembling step of the discharging electrode S40.

In the preparing step S10, components for the filter 1 such as the frame 3, the collecting electrode 5, the discharging electrode 7 and the discharging frame may be prepared. At first the frame 3 may be prepared for assembling the collecting electrode 5 and the frame 3 has a pair of board members 11 front and back, respectively, wherein the board members 11 has a plurality of assembling holes 18. The collecting electrode 5 may be manufactured, wherein the plurality of hooking protrusions 23 may be protruded at the outer circumferential surface adjacent to the end part 25 and arranged along in the direction of the periphery. As shown FIG. 10 and FIG. 15, the preparing step S10 may comprise a sheet metal working step S11, a rolling step S12 and welding step S13.

In the sheet metal working step S11, as shown in FIG. 15, a metal board material S may be cut for manufacturing the collecting electrode 5, and the thin metal board material S may be a rectangular form with a dimension as the same as the collecting electrode 5 is unrolled. And then hooking protrusion 23 may be formed along a pair of edges opposite to each other, preferably the shorter pair of edges.

And then, as shown in FIG. 15, in the rolling step S12, the processed metal board material S may be rolled into a shape of a cylinder. A pair of edges having no hooking protrusion 23, namely the longer edges among four edges of the metal board material S may meet by rolling to make a cylindrical form for the collecting electrode 5. The hooking protrusion 23 may be located on the surface of the metal board material S because the hooking protrusion 23 should be hooked on the edge of the assembling holes 18 of the frame 3. The rolling direction may be determined as the above mentioned process can be proceeded. The inner and outer circumferential surface may be determined in the direction of protruding the hooking protrusion 23 on the surface.

And then, the welding step S13 may be proceeded following the rolling step S12. In the welling step S13, the pair of edges to meet each other by rolling the metal board material S as the form of the cylinder may be welded, wherein the welded edges are the longer edges with the hooking protrusion 23. The welding process may comprise seam welding, spot welding, laser welding and the like.

The preparing step S10 may comprise a cutting step S14, a first bending step S15 and a second bending step S16, as shown FIG. 10 and FIG. 16, and the discharging electrode 7 may be prepared in the preparing step S10.

In the cutting step S14, a wire W to be made into the discharging electrode 7 may be cut in some length considering a gap of the discharging frame 19.

And also, a connecting unit 31 may be formed at each end of the cut wire W in the bending step S15. The wire W cut in a suitable length is bent as a first process, wherein the each end of the cut wire W may be bent as a first bending part 35 is a boundary. The bent wire W may become more separated from the axial line as extending backward, and, than be angled upward to form a front end angled part 32 contacting an inner circumferential surface of the collecting electrode 5 at a second bending part 35. And then, the end of the front end angled part 32 may be bent as the second bending part 35 is a boundary to form a rear end angled part 34. The wire W may angle downward from the second bending part 35 to contact an inner circumferential surface of the collecting electrode 5 at a second contacting part 37 opposite to the second bending part 35.

Finally, the tensile spring 27 may be formed at one side of the wire W in the second bending step S16. One either end of the wire W with the connecting unit 31 may be rolled into a coil spring to form the tensile spring 27 on the axial line, wherein one either end may be a part adjacent to the connecting unit 31.

The main body as the form of the wire, the connecting unit 31 of the ends of the main body and the tensile spring 27 adjacent to the connecting unit 31 may be manufactured separately, but preferably the connecting unit 31 and the tensile spring 27 may be in a single material by bending one strain wire as mentioned above.

The frame 3 and the collecting electrode 5 may be assembled in the assembling step of the collecting electrode S20 comprising the inserting step S21 and finishing step S22.

In the inserting step S21, the collecting electrode 5 may be inserted into each assembling hole 18 formed on the front and rear board member 11 of the frame 3. The collecting electrode 5 may be pressed in the radial direction to be deformed for inserting. The thin board type of the metal board material S may be manufactured by rolling into the shape of the cylinder to have elastic property as mentioned above. Hence the collecting electrode 5 can be inserted into the assembling hole 18 easily in spite of the hooking protrusion 23. The end part 25 of the collecting electrode 5 inserted at a predetermined location in a snap method may be protruded, but may recover as the original form by elasticity to prevent from breaking away out of the assembling hole after being assembled.

The assembling process may be finished in the finishing step S22. The process for assembling the collecting electrode 5 may be finished by pressing the end part 25 on the surface of the board member 11 of the frame 3 in sequence or at the same time, wherein the end part 25 of the collecting electrode 5 may be protruded out of the assembling hole 18 after being inserted into the assembling hole 18. Hence the end part 25 protruded out of the assembling hole 18 may be formed as a conferential part 21 by being pressed on the surface of the board member 11.

A pressing tool P may be used as a dedicated tool for pressing the end part 25 of the collecting electrode 5. The pressing tool P may have an arch shape of a pressing groove G at a middle portion of an outer circumferential surface with a same diameter as that of the collecting electrode 5. And the pressing groove G may press the end part 25 of the collecting electrode 5 in sequence or at the same time in the axial direction to make the end part 25 be a shape similar to the sectional shape of the pressing groove G in the arch longitudinal sectional shape.

The discharging frame 19 may be mounted on an outer part of the board member 11 of the frame 3 in the mounting step of the discharging frame S30. The discharging electrode 7 may be mounted within the collecting electrode 5 by being installed at the board member 11 previously after the collecting electrode 5 is inserted into the assembling hole 18 of the frame 3. The discharging frame 19 may be insulated to the frame 3 or the collecting electrode 5 by being mounted at the frame 3 using the insulating member 15 such as an insulator, wherein the insulating member 15 may be secured in removable fashion. The insulating member may be coupled in a removable manner for removing afterward, in particular may be displaced within an insulating room 17 located in the frame 13 for avoiding the contact with an air stream during collecting particles.

The discharging electrode 7 may be arranged within the collecting electrode 5 in the axial direction in the assembling step of the discharging electrode S40, wherein the discharging electrode 7 may be mounted within the collecting electrode 5 using the discharging frame 19 secured at the frame 3 as an insulating structure removable fashion. A plurality of connecting holes 29 may be formed on the inner surface of the discharging frame 19 as each connecting hole 29 matches each collecting electrode 5. Hence the discharging electrode 7 having the connecting unit 31 at both end parts may be coupled to the discharging frame 19 easily by being inserted into the connecting holes 39 in one touch pressing manner. The connecting unit 31 may be inserted within the connecting hole 39 easily because a second contacting part 37 is in the forward direction, while it is difficult to remove the connecting unit 31 from the connecting hole 29 without a particular tool because the second contacting part 37 is hooked in the reverse direction. And the tensile spring 27 may be formed at either end of the discharging electrode 7. Hence the tensile spring 27 may be drawn previously for generating a tensile force when the connecting unit 31 is inserted into the connecting hole 29 to prevent the discharging electrode 7 from being loose in spite of the high heat.

According to present invention, the assembling and manufacturing efficiency of the dust collecting filter may be improved in spite of the number of the used dust collecting electrodes, because the dust collecting electrodes are made as a thin plate shape and a light weight structure and the dust collecting electrodes is not welded to the board members.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A method for manufacturing an electrical dust filter, comprising:

preparing a frame having a board member with a plurality of assembling holes, a collecting electrode having a plurality of hooking protrusions protruded on a circumference adjacent to an end part and arranged along a periphery, a discharging electrode to generate an electrical discharge and arranged along an axle line direction, and a discharging frame to couple the discharging electrode to the frame in an insulating state;

assembling the collecting electrode to the assembling holes of the frame;

coupling the discharging electrode to the frame with an insulating member after the collecting electrode is inserted into the assembling hole; and arranging the discharging electrode on the frame in the axle line direction within the collecting electrode wherein the discharging frame is insulated from the frame, wherein the step of assembling comprising, inserting the collecting electrode into the assembling holes of the frame by deforming the collecting electrode with elasticity in a radial direction; and forming a boundary part by pressing the end part of the collecting electrode on a surface of the board member where the end part is protruded out of the board member on being inserted into the assembling holes in the axle line direction, wherein the step of the preparing comprising, cutting a wire W with a length corresponding to that of the discharging electrode;

forming a connecting means at both ends of the wire W; and forming a tensile spring at either end of the wire W adjacent to the connecting means in the axle line direction.

2. The method according to claim 1, wherein the preparing step further comprising, protruding a plurality of hooking protrusions at the end part according to a pair of opposite sides among four sides of a rectangular metal board object;

rolling the other opposite sides among four sides of the rectangular metal board S object to protrude the hooking protrusions; and welding the other opposite sides of the rectangular metal board object to meet by rolling.

3. The method according to claim 1, wherein the connecting means 31 comprising, a front angled part formed by bending the end part of the discharging electrode bordering a first bending part angled backwardly and eventually to a second bending part; and a rear angled part formed by bending the discharging electrode bordering the second bending part to contact the wire rear end of the discharging electrode with an inner wall of the discharging frame at the opposite part of the second bending part.

4. The method according to claim 1, wherein the discharging frame is placed at one side of the board member, and the discharging electrode has a shape of a circular section rod supported by the discharging frame.

5. The method according to claim 4, wherein the discharging electrode has a plurality of discharging cores protruded around the circular section rod in the radial direction.

6. The method according to claim 1, wherein, in the step of installing the insulating member, the insulating member is secured in removable structure within the frame to avoid a contact with a fluid.

* * * * *